United States Patent [19]

Osip et al.

[11] Patent Number: 4,991,731

[45] Date of Patent: Feb. 12, 1991

[54] RETORTABLE COMPOSITE CLOSURE FOR PLASTIC CONTAINERS

[75] Inventors: Thomas W. Osip; Paul A. Pezzoli, both of Worthington, Ohio

[73] Assignee: Abbott Laboratories/Ross Laboratories, Columbus, Ohio

[21] Appl. No.: 388,882

[22] Filed: Aug. 3, 1989

[51] Int. Cl.[5] ..... B65D 41/00; B65B 7/00; B65B 51/10

[52] U.S. Cl. ..... 215/232; 215/276; 156/69; 53/478

[58] Field of Search ..... 215/232, 276; 156/69; 53/478

[56] References Cited

U.S. PATENT DOCUMENTS

| | | | |
|---|---|---|---|
| 4,782,968 | 11/1988 | Hayes | 215/276 |
| 4,809,858 | 3/1989 | Ochs | 215/276 |
| 4,815,617 | 3/1989 | Cullum | 215/232 |

*Primary Examiner*—Stephen P. Garbe
*Assistant Examiner*—Nova Stucker
*Attorney, Agent, or Firm*—D. O. Nickey; L. R. Drayer; E. H. Gorman, Jr.

[57] ABSTRACT

This invention relates to a closure which permits the opening of a hermetically sealed plastic container in a single action motion, which also maintains the hermetic seal under retort conditions. This closure includes a generally cylindrical side wall having threads along the inner surface thereof and a top portion having a metallic disk with its lower surface coated with a fusible coating, such as polypropylene. An annular flange is provided along the inner surface of the side wall to retain the metallic disk between the annular flange and an inwardly inclined inner surface portion of the side wall. A method is also disclosed for providing a hermetic seal on plastic containers using the closure of this invention.

14 Claims, 3 Drawing Sheets

RETORTABLE COMPOSITE CLOSURE FOR PLASTIC CONTAINERS

TECHNICAL FIELD

The present invention relates generally to a closure for a plastic container, and more particularly, to a metal/plastic composite closure which permits the maintaining of a hermetic membrane seal and provides easy, singular action removal of the seal from a plastic pediatric nutritional food, adult nutritional food, or pharmaceutical product container.

BACKGROUND ART

To ensure proper nutritional support for newborn infants, many doctors and hospitals recommend the use of liquid pediatric nutritional products. Pediatric nutritional products are utilized when breast feeding is not possible for either medical and/or social reasons. Furthermore, even in cases where breast feeding is possible, some mothers prefer the convenience afforded by the use of pediatric nutritional products.

In response to the need for pediatric nutritional products soy and milk-based liquid foods have been developed for bottle feeding in conjunction with a rubber or latex nipple. Since the containers for these nutritional products should provide a twelve to eighteen month shelf life, a hermetic seal must be provided across the top of the container. A hermetic seal is one which when in place is impervious to microbiological intrusion and external influence. Presently, hermetic sealing is accomplished through the use of a glass container, to which is secured by vacuum closure a stamped steel cap having a pre-cut rubber or vinyl plastisol gasket. The sealed container is then subjected to temperatures above the ambient air temperature, and more specifically to retort conditions, during which the hermetic seal must survive sterilization of the nutritional product and the container. Since the glass container and the stamped-steel cap expand a similar amount and since a vacuum is present within the container, the hermetic seal is usually maintained during the sterilization process.

Due to concerns about material cost, container weight, and breakage, suppliers of nutritional products have sought to manufacture the product container from a plastic substance, such as polypropylene, which is relatively clear, optically, and cost effective as compared to glass. A problem arises in attempting to provide a cap for a plastic container, which cap still maintains a hermetic seal. Since it is difficult to maintain a vacuum in a plastic container, and conventional metal caps and plastic containers expand by a dissimilar amount, the prior art metal caps can not maintain a hermetic seal on plastic containers when subjected to retort conditions.

Another problem arises in that the heat during retort conditions causes polymer relaxation or shrinkage, especially in the upper neck portion of the container. Injection or extrusion molded plastic bottles are formed by stretching the polymer molecules. The introduction of heat causes those molecules to relax, so as to actually shrink the diameter of the neck. This shrinkage causes severe problems in maintaining a conventional metal cap on a plastic bottle. This shrinkage also prevents the use of a conventional plastic cap on a plastic bottle.

One approach to overcome these problems would be to apply a substantial amount of torque when initially capping the bottle. However, the amount of torque necessary to maintain a conventional cap on a plastic bottle is so high that a person would not be able to easily twist off the cap following retort. Another possible approach would be to fabricate a bottle from a plastic which does not shrink at retort temperatures and can maintain an internal vacuum without distortion, however, the cost of providing such a plastic bottle would is prohibitive.

Yet another possible approach to the providing of a hermetic seal to a plastic container would be to utilize a barrier membrane, such as aluminum foil, such that the integrity of the seal is independent of the closure or cap. This primary membrane seal or foil would be protected from accidental or premature puncture by an overcap of conventional design. One type of foil seal is the type which is peelable. However, in dealing with nutritional products subject to spoilage, peelable seals are not optimal for maintaining confidence that the product has not been tampered with and or for ensuring against spoilage. Additionally, peelable foils also encounter difficulty surviving sterilization without encountering problems in their removal.

A heat-fused metallic seal, which imparts a permanent seal, fused to the container is more desirable. However, the use of a conventional heat-fused foil membrane necessitates that the outer cap be removed, followed by the piercing of the membrane seal. The piercing is usually accomplished by a microbial laden device, such as a pair of scissors or a fingernail, thereby contaminating the pediatric nutritional product with bacteria.

It is thus apparent that a need exists for an improved closure for a pre-filled, membrane-sealed pediatric nutritional product containers which provides system seal integrity during retort, as well as permitting the sanitary opening of the container in a single action motion.

DISCLOSURE OF THE INVENTION

There is disclosed a closure for plastic containers, said closure comprising, a upper portion, said upper portion comprising a metallic disk, said disk having an edge portion and a center portion, said disk having an upper surface and a lower surface, said lower surface having applied thereto a fusible coating, and a generally cylindrical side wall, said side wall having an outer surface and an inner surface, said closure having container retaining means located along said inner surface for cooperative engagement with said plastic container, said closure having upper portion retaining means for retaining said upper portion in cooperative relationship to said inner surface of said side wall.

There is also disclosed a closure for plastic containers, said closure comprising a upper portion, said upper portion comprising a metallic disk, said disk having an edge portion and a center portion, said disk having an upper surface and a lower surface, said lower surface having applied thereto a fusible coating, said coating being of polypropylene, and a generally cylindrical side wall, said side wall having an outer surface and an inner surface, said closure having container retaining means located along said inner surface for cooperative engagement with said plastic container, said retaining means comprised of an inwardly projecting flange, said closure having upper portion retaining means for retaining said upper portion incooperative relationship to said inner surface of said sidewall, said inner surface having a portion thereof forming an inclined inner surface, said metallic disk capable of being retained between said inwardly projecting flange and said inclined inner surface.

There is also disclosed a method for providing an easy open seal for plastic containers, comprising placing a metallic disk inside a closure, said closure comprising an upper portion and a side wall, said metallic disk having an edge portion and a center portion, said disk having an upper surface and a lower surface, said lower surface having applied thereto a fusible coating, said side wall being generally cylindrical, said side wall having an outer surface and an inner surface, said closure having container retaining means located along said inner surface for cooperative engagement with said plastic container, said closure having upper portion retaining means for retaining said upper portion in cooperative relationship with said inner surface of said side wall, cooperatively engaging said closure with said plastic container, and fusing said fusible coating to said plastic container.

Additional aspects of the method include the application of downward pressure to said metallic disk to cooperatively engage said closure with said plastic container, the twisting of the closure so as to apply an upward pressure to said metallic disk thereby breaking the seal, and the removal of the closure from said cooperative engagement with said plastic container, such that the metallic disk is completely removed from contact with said plastic container, yet retained in cooperative relationship with said inner surface of said side wall.

Additionally, the outer surface of the closure has a lower portion, a middle portion and an upper portion, each of said lower portion, middle portion and upper portion having a respective lip, with said upper portion also having an inclined portion and an annular upper edge.

The present invention provides a closure which maintains a hermetic seal when the container to which it is attached is subjected to retort conditions, and also allows an easy, singular action removal of the seal without contaminating the nutritional or pharmaceutical product.

Yet another important aspect of this invention is to provide a simple method of fabrication of a retortable metal/plastic composite closure.

Other aspects and advantages of the invention will be apparent from the following description, the accompanying drawings and the appended claims.

DETAILED DESCRIPTION OF THE INVENTION

Figure 1:
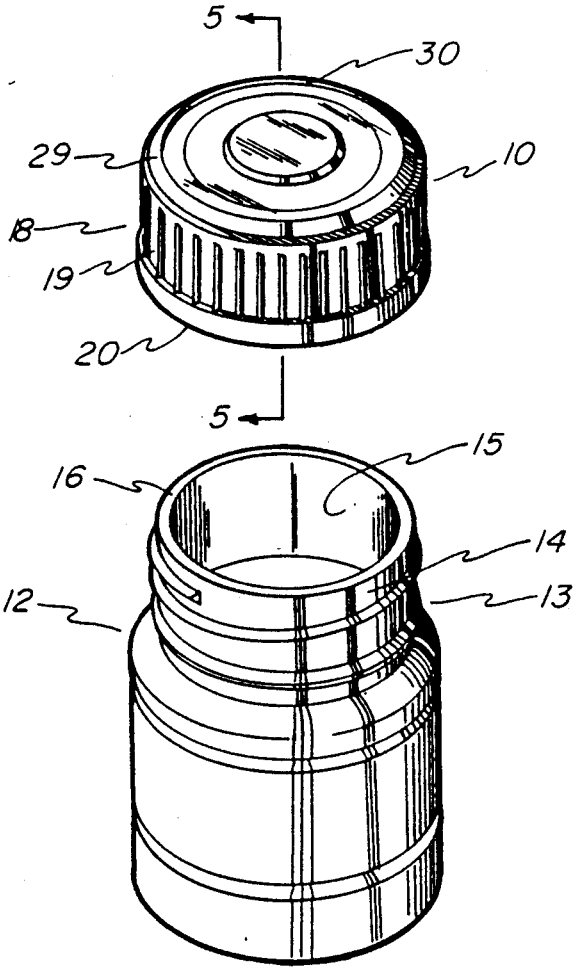
FIG. 1 is a perspective view of the closure in accordance with the present invention shown in conjunction with a plastic container with which it is used.
Figure 2:
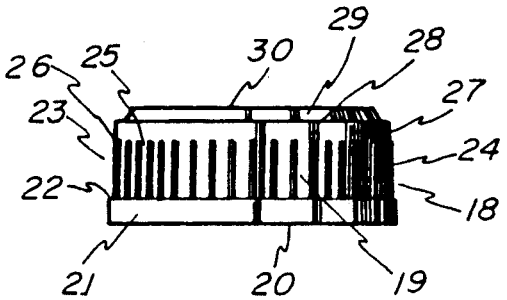
FIG. 2 is a side elevational view.
Figure 3:
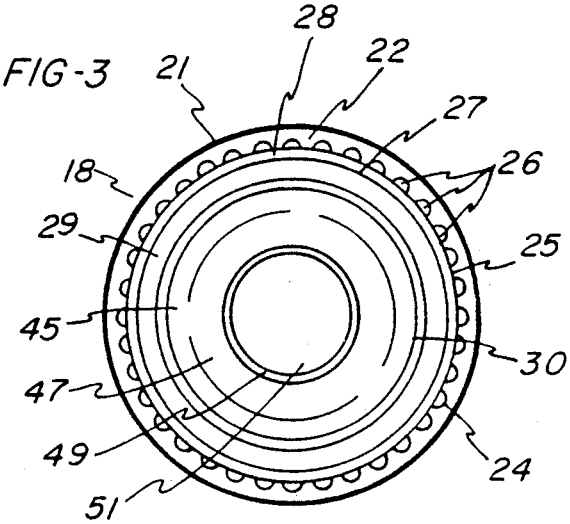
FIG. 3 is a top plan view of the closure.

Having reference to the drawings, attention is directed first to FIG. 1 which illustrates a closure for a pediatric nutritional container shown in conjunction with such a container, with the closure being designated by the numeral 10 and the plastic nutritional product container being designated by the numeral 12. Plastic container 12 has a threaded neck 13 with neck outer surface 14, neck inner surface 15 and neck top surface 16. As can be seen in FIGS. 1, 2 and 3, the closure 10 of this invention comprises a sidewall 18 having an outer surface 19 and inner surface 20. Outer surface 19 has a smooth faced, cylindrical lower portion 21. A lower lip 22 extends inwardly from the top of lower portion 21 towards middle portion 23 of outer surface 19. This middle portion 23 is shown as comprised of a series of vertically spaced columns 24 between which are located recessed planar portions 25. A thin middle lip 26 extends further inwardly from middle portion 23 towards upper portion 27 of outer surface 19. Upper portion 27 resembles lower portion 21, but with a lesser diameter. Along its upper edge is a top lip 28. A top inclined portion 29 rises inwardly from top lip 28, and extends further inwardly or centrally. Depending from outer surface 19 is an annular upper edge 30, which can best be seen in FIG. 3, 5 and 7. As shown, it is slanted inwardly and downwardly from the apex of side wall 18.

Figure 4:
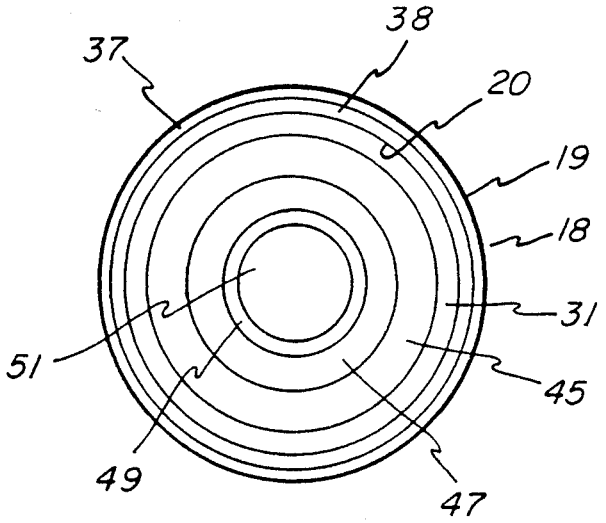
FIG. 4 is a bottom plan view of the closure.
Figure 5:
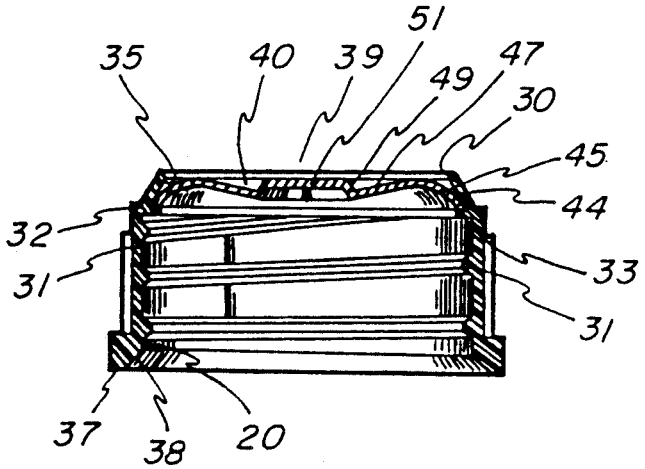
FIG. 5 is a vertical sectional view on an enlarged scale taken along line 5—5 of FIG. 1.

The inner surface 20 of side wall 18 has a plurality of threads 31. As can be seen in FIGS. 4 and 5, the upper most portion of threads 31 flows into an annular flange 32 having a flange top surface 33. Since the annular flange 32 does not cooperatively engage the plastic container in the mechanically interfitting frictional relationship associated with threads 31, the flange need not project inwardly as far as threads 31. Extending upwardly from the annular flange 32 along the inner surface 20 of side wall 18 is an inclined inner surface 35 which extends centrally. The side wall 18 also has an annular bottom edge 37. An inwardly inclined edge portion 38 extends from annular bottom edge 37 to the portion of the inner surface 20 which lies parallel to lower portion 21. Furthermore, although the threads 31 are shown with inclined top and bottom surfaces, this particular configuration is not necessary so long as cooperative engagement with the plastic container can be established and maintained. Further, the annular flange 32 is parallel to annular bottom edge 37, such that it extends perpendicularly from that portion of the side wall 18 associated with upper portion 27.

Figure 7:
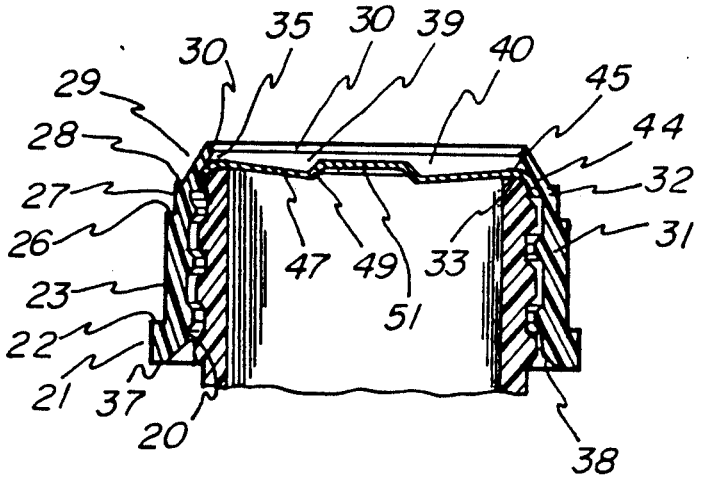
FIG. 7 is a vertical sectional view on an enlarged scale similar to FIG. 5, but showing the closure in operative relationship with a plastic container so as to effect a hermetic seal.
Figure 6:
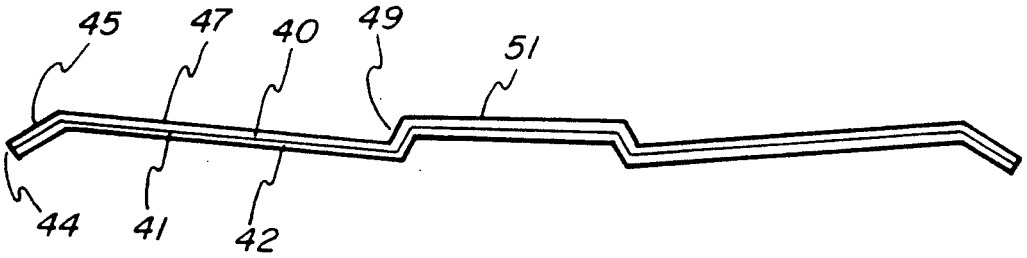
FIG. 6 is a vertical sectional view of that portion of FIG. 5 showing the metallic disk utilized in the invention.

As can best be seen in FIG. 5, 6 and 7, the top portion 39 is comprised primarily of a metallic disk 40 with the disk lower surface 41 having applied there to a fusible coating 42, preferably of polypropylene. Preferably the metallic disk would be fabricated from aluminum of a thickness between 0.10 and 0.30 millimeters, with the film being approximately 0.015 millimeters thick. The film or fusible coating 42 could be applied by conventional solvent coating systems utilizing current metal coating technology such as is used in foil technology. The choice of aluminum for the metallic disk is an excellent choice since the rigidity of the metal forming the disk must be greater than the peel strength, otherwise the metallic disk will be subject to bending and unsightly deformation upon removal of the closure from the plastic container. The metallic disk has an edge portion 44, an outer portion 45, a downwardly inclined portion 47, an upwardly inclined portion 49, and a center portion 51. The dome associated with center portion 51 and upwardly inclined portion 49 of metallic disk 40 behave as a vacuum button to further provide assurance that the hermetic seal has not been broken.

BEST MODE

In actual operation, the heat fusible metallic disk is placed inside closure 10. The closure of this invention is then cooperatively engaged with the plastic container by screwing on the closure, which provides an application of downward pressure to the metallic disk 40 by inclined inner surface 35, as inclined inner surface 35 makes mechanical contact with outer portion 45 of metallic disk 40. The plastic container is preferably fabricated from polypropylene, such that the closure upon being subjected to a source of electromagnetic energy induced by an induction coil, such as an electromagnetic current, the metallic disk has its molecules excited so as to cause the fusible coating 42 to melt and fuse the disk lower surface 41 with the necktop surface 16. This fusing forms a hermetic seal, which is capable of surviving retort conditions up to 135° C.

To open the plastic container associated with the embodiment of this invention, an individual grasps the closure 10 and twists so as to apply an upward pressure to the metallic disk as the disk comes into contact with the flange top surface 33 of annular flange 32. This upward pressure breaks the hermetic seal in an easy, singular action motion. The continued twisting of the closure ultimately removes the closure from cooperative engagement with the plastic container, such that the metallic disk is completely removed from contact with the plastic container yet still retained in cooperative relationship with the inner surface of the side wall.

The closure of this invention permits the opening of the container in a single action motion and once the metallic disk is detached from the container, the continued twisting of the closure leaves the container in a pourable condition without any subsequent opening procedures via the use of a finger or tool to open a membrane seal.

INDUSTRIAL APPLICABILITY

Annually, approximately 200,000,000 units of pediatric nutritional products are distributed in the U.S., with many of these units utilizing glass containers and stamped-steel metal caps. The industry has long sought ways to eliminate the glass containers and move to a less expensive cap as well.

While this invention can be used on all plastic containers, it is specifically designed for plastic containers that are filled with a product and/or sterilized at temperatures exceeding 71° C., and more specifically for plastic containers which are sterilized at temperature exceeding 100° C.

While the form of apparatus and method herein described constitute a preferred embodiment of this invention, it is to be understood that the invention is not limited to this precise form of apparatus or method and that changes may be made therein without departing from the scope of the invention, which is defined in the appended claims.

What is claimed is:

1. A closure for plastic containers, said closure comprising, an upper portion, said upper portion comprising a metallic disk, said disk having an edge portion and a center portion, said disk having an upper surface and a lower surface, said lower surface having applied thereto a fusible coating, and a generally cylindrical side wall, said side wall having an outer surface and an inner surface, said closure having container retaining means located along said inner surface for cooperative engagement with said plastic container, said closure having upper portion retaining means for retaining said upper portion in cooperative relationship to said inner surface of said side wall, said outer surface having a lower portion, a middle portion, and an upper portion, each of said lower portion, middle portion and upper portion having a respective lip, with said upper portion also having an inclined portion and an annular upper edge.

2. The closure as claimed in claim 1 wherein said container is a nutritional or pharmaceutical product container.

3. The closure as claimed in claim 2 wherein said upper portion retaining means comprises an inwardly projecting flange.

4. The closure as claimed in claim 3 wherein said inner surface has a portion thereof forming an inclined inner surface.

5. The closure as claimed in claim 3 wherein said metallic disk is retained between said inwardly projecting flange and said inner surface.

6. The closure as claimed in claim 3 wherein said container retaining means comprises threads.

7. The closure as claimed in claim 3 wherein said fusible coating is polypropylene.

8. A closure for plastic containers, said closure comprising, an upper portion, said upper portion comprising a metallic disk, said disk having an edge portion and a center portion, said disk having an upper surface and a lower surface, said lower surface having applied thereto a fusible coating, said coating being of polypropylene, and a generally cylindrical side wall, said side wall having an outer surface and an inner surface, said closure having container retaining means located along side inner surface for cooperative engagement with said plastic container, said closure having upper portion retaining means for retaining said upper portion in cooperative relationship to said inner surface of said side wall, said upper portion retaining means comprised of an inwardly projecting flange, said inner surface having a portion thereof forming an inclined inner surface, said metallic disk capable of being retained between said inwardly projecting flange and said inclined inner surface, said outer surface having a lower portion, a middle portion, and an upper portion, each of said lower portion, middle portion and lower portion having a respective lip, with said upper portion also having an inclined portion and an annular upper edge.

9. The closure as claimed in claim 8 wherein said container is a nutritional or pharmaceutical product container.

10. A method for providing an easy open seal for a plastic container, comprising placing a metallic disk inside a closure, said closure comprising an upper portion and a side wall, said metallic disk having an edge portion and a center portion, said disk having an upper surface and a lower surface, said lower surface having applied thereto a fusible coating, said side wall being generally cylindrical, said side wall having an outer surface and an inner surface, said closure having container retaining means located along said inner surface for cooperative engagement with said plastic container said closure having upper portion retaining means for retaining said upper portion in cooperative relationship with said inner surface of said side wall, cooperatively engaging said closure with said plastic container, said cooperative engagement including the application of downward pressure to said metallic disk, fusing said fusible coating to said plastic container to form a seal, and twisting the closure so as to apply an upward pressure to said metallic disk thereby breaking said seal.

11. The method of claim 10 wherein said fusing occurs upon the passage of said plastic container through an electromagnetic current.

12. The method of claim 10 which includes the removal of the closure from said cooperative engagement with said plastic container, such that the metallic disk is completely removed from contact with said plastic container, yet retained in cooperative relationship with said inner surface of said side wall.

13. The method of claim 10 wherein said plastic container is a nutritional or pharmaceutical product container.

14. The method of claim 11 which includes the removal of the closure from said cooperative engagement with said plastic container, such that the metallic disk is completely removed from contact with said plastic container, yet retained in cooperative relationship with said inner surface of said side wall.

* * * * *

UNITED STATES PATENT AND TRADEMARK OFFICE

CERTIFICATE OF CORRECTION

PATENT NO. : 4,991,731

DATED : Feb. 12, 1991

INVENTOR(S) : Thomas Osip and Paul Pezzoli

It is certified that error appears in the above-identified patent and that said Letters Patent is hereby corrected as shown below:

Claim 8, Col. 6, Line 40, "side" should be --said--

Claim 8, Col. 6, line 51, "lower" should be --upper--

Claim 10, Col. 6, line 67-68, should change "container said" to --container, said--

Signed and Sealed this

Twenty-eighth Day of July, 1992

*Attest:*

DOUGLAS B. COMER

*Attesting Officer*

*Acting Commissioner of Patents and Trademarks*